US009824543B2

(12) United States Patent
Alexander

(10) Patent No.: US 9,824,543 B2
(45) Date of Patent: Nov. 21, 2017

(54) METHODS AND SYSTEMS FOR PROVIDING A PARLAY CARD SWEEPSTAKES OPPORTUNITY

(71) Applicant: KIZZANG LLC, Las Vegas, NV (US)

(72) Inventor: Robert Alexander, Las Vegas, NV (US)

(73) Assignee: KIZZANG LLC, Las Vegas, NV (US)

( * ) Notice: Subject to any disclaimer, the term of this patent is extended or adjusted under 35 U.S.C. 154(b) by 0 days.

(21) Appl. No.: 15/212,794

(22) Filed: Jul. 18, 2016

(65) Prior Publication Data

US 2016/0328924 A1 Nov. 10, 2016

Related U.S. Application Data

(63) Continuation of application No. 14/539,934, filed on Nov. 12, 2014, now Pat. No. 9,424,717.

(51) Int. Cl.
*G07F 17/32* (2006.01)

(52) U.S. Cl.
CPC ..... *G07F 17/3288* (2013.01); *G07F 17/3244* (2013.01)

(58) Field of Classification Search
CPC ..... G07F 17/32
See application file for complete search history.

(56) References Cited

U.S. PATENT DOCUMENTS

| | | | |
|---|---|---|---|
| 6,688,978 | B1 | 2/2004 | Herman |
| 7,563,162 | B2 | 7/2009 | Lawson et al. |
| 2015/0298000 | A1 | 10/2015 | Hirsch |

*Primary Examiner* — Omkar Deodhar
(74) *Attorney, Agent, or Firm* — Ascenda Law Group, PC

(57) ABSTRACT

A parlay card sweepstakes opportunity is presented to a player via a web site hosted by a computer system. The parlay card sweepstakes opportunity may include one or more player-selectable parameters for the selection of previously generated pre-populated parlay cards associated with the sweepstakes opportunity. The pre-populated parlay cards may be stored in a data store that is accessed upon receiving a parameter selection from the player. The pre-populated parlay cards include a plurality of events as well as predicted outcomes for these events. A particular pre-populated parlay card may be selected from the plurality of previously generated pre-populated parlay cards and presented to the player via the web site. Actual outcome information regarding events included in the pre-populated parlay card may then be received and a prize may be presented to the player based a combined actual outcome of the plurality of events included on the pre-populated parlay card.

18 Claims, 5 Drawing Sheets

500

Parlay Card

| Event Number | Pick |
|---|---|
| 1 | Team A |
| 2 | Team D |
| 3 | Team E |
| 4 | Team H |

600

METHODS AND SYSTEMS FOR PROVIDING A PARLAY CARD SWEEPSTAKES OPPORTUNITY

RELATED APPLICATIONS

This application is a CONTINUATION of U.S. patent application Ser. No. 14/539,934, filed Nov. 12, 2014, incorporated herein by reference.

FIELD OF THE INVENTION

The present invention relates to on-line gaming, and more specifically to a sweepstakes for use in connection with an on-line service as a means of facilitating parlay card gaming.

BACKGROUND

Parlay cards are known in the art for enabling a user to place multiple wagers as a single bet and, if any one wager is lost by the player, the entire bet is lost. To place a bet using a parlay card, a player traditionally picks a winning contestant for each of the series of contests. Typically, these contests are sporting events such as football or basketball games and the contestants are sporting teams or players.

Generally speaking, the more wagers included in a parlay card, the higher the payoff for winning the bet. For example, if a player places 8 wagers on a single parlay card, the payoff for winning the bet will be higher than if the player places 5 wagers on a single parlay card. If one of the wagers ends in a tie, traditionally, the number of wagers included on the parlay card is reduced by one. For example, if there are 6 wagers on a parlay card and one of the wagers ends in a tie, then the payoff for the parlay card would be consistent with the payoff for a 5-wager parlay card.

BRIEF DESCRIPTION OF THE DRAWINGS

The present invention is illustrated by way of example, and not limitation, in the figures of the accompanying drawings, in which.

DETAILED DESCRIPTION

Figure 1:
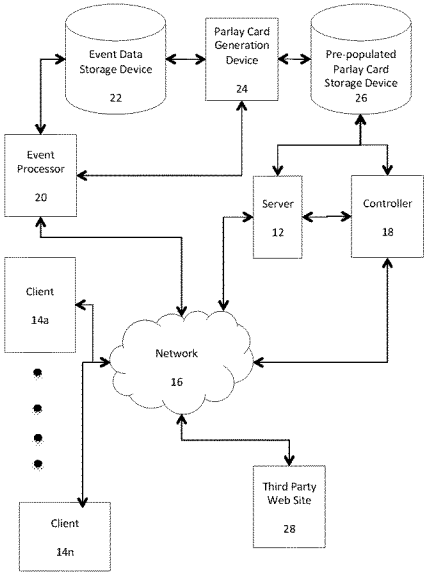
FIG. 1 illustrates an example of a network environment within which embodiments of the invention may be instantiated.

In various embodiments, the present invention provides methods and systems for providing an opportunity to participate in on-line parlay card sweepstakes opportunities for one or more players. In some instances, the present invention provides a sweepstakes for use in connection with the on-line parlay card gaming or betting schemes and players who may win a parlay card bet, may win a sweepstakes prize. Players who may not win a parlay card bet may be entered into the sweepstakes. A sweepstakes prize may be instantiated in various forms such as cash, merchandise, continued gameplay, and/or entry into additional sweepstakes or contests.

Pre-populated parlay cards may include a plurality of contests selected from a database of such contests for a specified time period. For example, parlay cards reflecting football games for a given week, or baseball or basketball games for a given day may be produced by an automated process that retrieves the contest information for the specified period from a database of such information and organizes it in the form of a parlay card. In accordance with embodiments of the present invention, however, the contests presented on a given parlay card are not restricted to a single sport. Instead, the contests organized on a single card are drawn from a number of activities, including sports, elections, or other activities.

In one embodiment, a parlay card is generated when a user specifies selections from the database of contests for inclusion on a parlay card. This may be done, for example, by the user browsing the database of contests and selecting contests for inclusion on a parlay card. In some instances parlay cards may be required to include a specified minimum number of contests. In other instances, eligibility for prizes associated with parlay cards may be determined based on the number of contests selected for inclusion on a parlay card. Only contests that have not yet commenced, or in some cases have not yet concluded, are eligible for selection to be included on a parlay card.

In other embodiments, the contests included on a parlay card are selected by an automated process and a user is required to select a pre-populated card from an assortment of proffered cards. Pre-populated cards may be generated by an automated process selecting contests for inclusion on a card from a database of contests. In such a database, contests may be organized by category, and the automated process may select a specified number of contests for inclusion on a pre-populated parlay card from each such category. In some instances, contests may have associated difficulty levels (e.g., an associated difficulty in correctly selecting the outcome of the contest) and pre-populated parlay cards may be generated so as to provide a specified level of difficulty based on individual contest difficulty levels. Eligible prizes associated with such cards may be determined accordingly. For example, parlay cards deemed to have a higher level of overall difficulty may be associated with prizes of greater value than parlay cards deemed to have a lower level of overall difficulty. In other instances, some sweepstakes may offer pre-populated parlay cards of relatively uniform overall difficulty level.

A further example of pre-populated parlay cards includes a series of contests or events and predicted or picked outcomes, or winners, for those contests or events. All of the predicted or picked outcomes, in the aggregate, may be considered a parlay card wager or bet. A player may win a parlay card wager or bet when all of the predicted/picked outcomes match the actual outcomes for the associated events. A grand prize may be presented to a player with a winning parlay card wager or bet. On some occasions, prizes less valuable than a grand prize may be presented to a player with a parlay card one or more loosing predicted/picked outcomes.

In some embodiments, the content, difficulty level, offered prizes, and/or appearance of a pre-populated parlay card and/or an event included therein may vary according to a schedule. For example, events relating to football games may only be offered for inclusion on a pre-populated parlay card during football season or a difficulty level associated with winning a parlay cards bet may increase as a sports season progresses or during a time of year when more players are likely to participate in the parlay card sweepstakes opportunity.

Before describing the present invention in detail it is helpful to provide an overview of the environment in which embodiments of the invention may be deployed. FIG. 1 illustrates an example of such an environment 100. In this example, server 12 hosts an on-line service through which any of a variety of goods or services may be purchased and/or used. For example, server 12 may host one or more web sites offered by a service provider that offer on-line parlay card sweepstakes opportunities to players. Alternatively, or in addition, movies, music or other forms of entertainment may be accessed through one or more of these web sites. Also, the web sites may offer goods or other services for lease or purchase by visitors. Indeed, the nature of the web sites hosted by server 12 is not critical to the present invention, however, it is preferable that the web sites be offered only to visitors that have registered for access to same, thereby allowing individual users to be identified each time they visit. Although illustrated as a single server, it should be appreciated that server 12 may in fact be multiple servers and may be segregated into web servers that are communicably coupled to one or more application servers, which themselves are communicably coupled to one or more databases storing user information, contest information, and other data.

Users (and herein the term player may be used interchangeably with the term user) access web sites and other facilities hosted by server 12 through clients 14*a*-14*n*. Examples of such clients include desktop computers, laptop computers, cellphones, smart phones, tablet computers, computer game consoles, portable computer gaming consoles, media players, portable media players, other mobile devices, and the like. Typically, clients 14*a*-14*n* communicate with server 12 over one or more networks 16, for example the Internet. Clients 14*a*-14*n* are preferably configured with applications that allow for the display of web pages. Such applications include web browsers and dedicated applications capable of rendering web pages and the like.

Also shown in FIG. 1 is a controller 18 that is communicably coupled to server 12. Controller 18 is a facility for the service provider associated with the web sites hosted at server 12 to maintain and otherwise configure those sites. In some cases, controller 18 may communicate with server 12 via network 16, while in other cases the communication may be over a virtual private network or the like and so is shown as a separate connection in the diagram.

Event processor 20 may be configured to gather information regarding one or more events that may be included in a pre-populated parlay card. That processor 20 may further be configured to process the gathered event information in order to, for example, categorize the event data and/or establish odds or other probabilities related to the event and/or an outcome of the event. In some embodiments, event processor 20 may be configured to gather event information from multiple sources including, for example, third-party data sources such as third-party website 28 and a dedicated database, such as event data storage device 22. Event data storage device 22 may also be configured to store event data gathered by event processor 20 and/or analysis of the gathered event data. In some embodiments event data storage device 22 may further be configured to store indexed event data.

A parlay card generation device 24 may be communicatively coupled to the event processor 20 and/or event data storage device 22 and may be configured to generate a plurality of pre-populated parlay cards using data from event processor 20 and/or event data storage device 22. Parlay card generation device 24 may be configured to generate pre-populated parlay cards that comply with a variety of parameters such as a number of events to be included on the parlay card, a minimum threshold for the odds or probability that a player will have a winning actual outcome for an individual event included on the parlay card or the combined events of the parlay card, a type of the event (sporting event, talent contest, survey results, elections, etc.). Once the parlay card generation device 24 generates the pre-populated parlay cards, they may be stored in pre-populated parlay card storage device 26 where they may be accessed by controller 18 for transmission to server 12 and eventual communication to clients 14*a*-14*n* via network 16.

Figure 2:
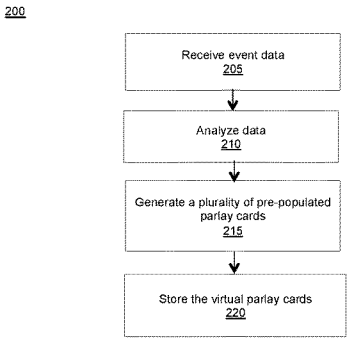
FIG. 2 illustrates an example of an exemplary process for generating pre-populated parlay cards in accordance with embodiments of the invention.

FIG. 2 is a flowchart depicting an exemplary process 200 for generating pre-populated parlay cards. Initially, event data may be received by, for example, event processor 20 and/or parlay card generation device 24 (step 205). The event data may be locally stored and/or retrieved from an external source such as third-party website 28. Event data may include data directly and indirectly related to an event that may be placed on a parlay card as well as a possible outcome of that event (i.e., a probability that a particular team will win the basketball game). Consider, for the sake of illustration, a basketball game between teams A and B. Event information directly related to the basketball game may include a date, time, and venue for the basketball game as well as a name for the opposing teams. Indirect event data for this basketball game may include various statistics regarding the previous performance of basketball teams A and B, a list of players for teams, and updated information regarding the health of those players, including any injuries that may prevent a particular player from participating in the basketball game.

In step 210, the received event data may be analyzed in order to, for example, aggregate information regarding a particular event that may be collected from a plurality of sources, categorize the event, determine the odds of particular outcome for the event, and prepare the event data and or predicted, or picked, outcomes for the events to be included on a pre-populated parlay card. The analyzed data may then be used to generate a plurality of pre-populated parlay cards (step 215), which may then be stored in a data storage device, such as pre-populated parlay card storage device 26 (step 220).

Pre-populated parlay cards may be generated by, for example, randomly or pseudo-randomly selecting events that meet one or more parameters and aggregating them into a single pre-populated parlay card. In some embodiments, one or more events may be associated with player characteristics and/or player-specific identification information and these characteristics and/or information may be used to generate one or more pre-populated parlay cards.

Figure 3:
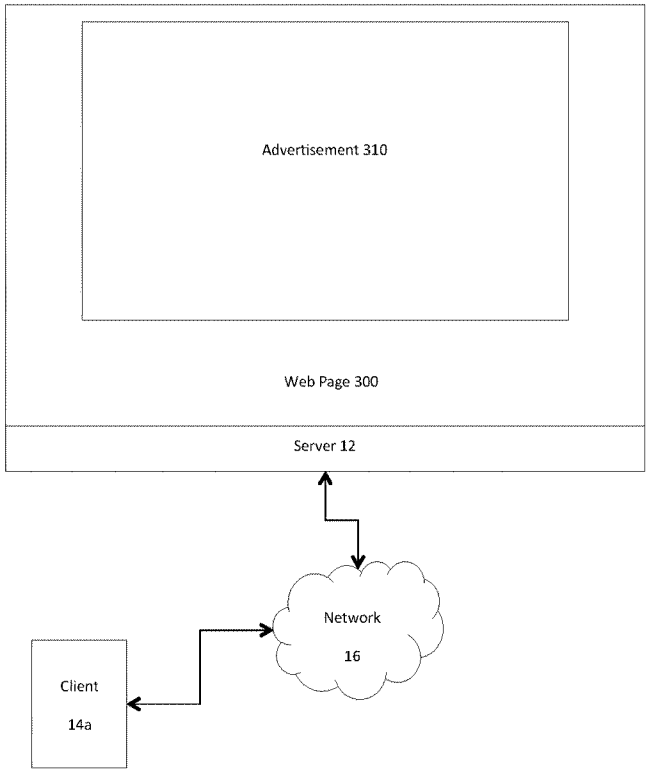
FIG. 3 illustrates an example of a web page including an advertisement that may be provided by a server to a client in accordance with embodiments of the invention.

Referring now to FIG. 3, when a player at client 14 accesses a service associated with a web site hosted at server 12, the player may be required to log-in (e.g., by presenting a user name and password). Upon successful verification of the player's credentials, a web page 300 that includes an advertisement 310 may be presented. Viewing the advertisement 310 (or multiple such advertisements) may be a condition of being permitted access to the services associated with the web sites hosted by server 12 and the player's agreement to view such advertisements may be part of the terms of service agreed to by the player when he/she enrolls with the service provider. The advertisement 310 may be any form of advertisement and may comprise one or more images, text materials, movies, audio-video presentations, etc. Although the user may be provided an opportunity to "skip" the advertisement and navigate directly to other web pages, server 12 is preferably configured to detect such navigation commands (typically in the form of mouse click or similar events associated with a hyperlink away from web page 300). Upon recognizing such a navigation command, server 20 may not present the player an opportunity to participate in a parlay card sweepstakes opportunity.

Figure 4:
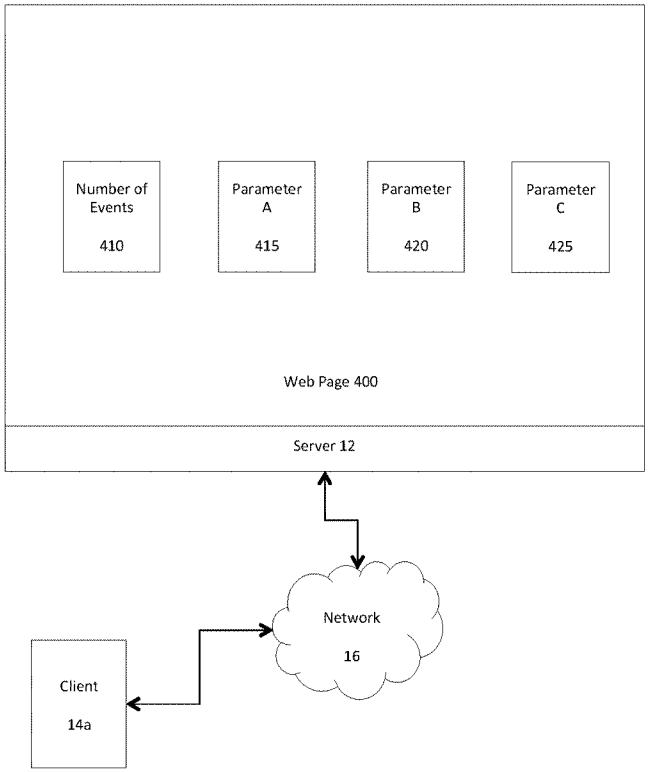
FIG. 4 illustrates an example of a web page that includes a pre-populated parlay card selection interface that may be provided by a server to a client in accordance with embodiments of the invention.

Assuming the player views the advertisement 310 through to its conclusion (e.g., if the advertisement is a movie or audio-video presentation) or for at least a designated period of time (e.g., specified by a count down timer or the like displayed in conjunction with web page 300), server 12 will present web page 400, shown in FIG. 4, to the player (e.g., via a web browser associated with client 14).

Web page 400 includes an interface with a number of user selectable buttons 410-425 via which a player may select a number of events to be included on a pre-populated parlay card (via number of events button 410) and one or more parameters for selecting a pre-populated parlay card (via parameter A button 415, parameter B button 420, and parameter C button 425). It is important to note that although the interface of web page 400 includes user selectable buttons 410-425, any method or mechanism by which a user may communicate information via web page 400 may be used including, but not limited to, drop-down menus, check boxes, text entry fields, and selectable icons.

Exemplary parameters that may be selected by activation of parameter A button 415, parameter B button 420, and/or parameter C button 425 include an event category (e.g., sports, consumer preference (e.g., Coca-Cola vs. Pepsi), survey results, electoral voting results, etc.), desired prize to be won, and/or a timeline for a completion of the events included on the pre-populated parlay card. In some embodiments, web page 400 may also include a search feature whereby a player may search for a particular type of pre-populated parlay card. Once all of the parameters for a pre-populated parlay card are selected, a pre-populated parlay card, such as exemplary pre-populated parlay card 500, as depicted in FIG. 5, may be selected and presented to the player.

Exemplary pre-populated parlay card 500 includes four separate events and the predicted, or picked, winner of each of these events, such that the team selected to win the first-fourth events are Team A, Team D, Team E, and Team H, respectively. In order for the player to win the sweepstakes opportunity provided by pre-populated parlay card 500, each of these teams must win their respective event. In practice, parlay cards having 5 or more, 10 or more, 15 or more, 20 or more, 50 or more, and/or 100 or more events are envisioned.

Figures 5, 6:
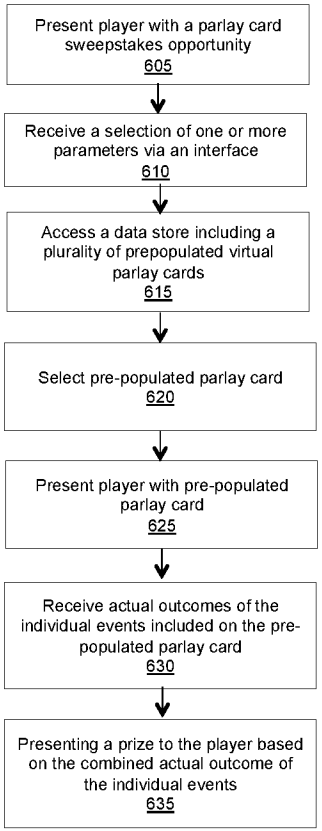
FIG. 5 illustrates an exemplary parlay card in accordance with embodiments of the invention.
FIGS. 6-8 illustrate exemplary processes for providing a parlay card sweepstakes opportunity to a player in accordance with embodiments of the invention.

FIG. 6 illustrates a process 600 for presenting a parlay card sweepstakes opportunity to a player by, for example, a host computer via a web site according to one embodiment of the invention. Process 600 may be executed by one or more components described herein.

Initially, a player may be presented with a parlay card sweepstakes opportunity via, for example, a web page, such as web page 300 and/or web page 400 hosted by a computer, such as server 12 (step 605). The player may be presented with the parlay card sweepstakes opportunity via a display device incorporated into client device operated by the player, such as client device 14. The parlay card sweepstakes opportunity may include one or more player-selectable parameters, such as a number of events to include on a pre-populated parlay card, a category of event, and/or a timeline for a completion of the events of the parlay card. A selection of one or more parameters may be received from the player via an interface, such as the interface provided by web page 400 (step 610).

In step 615, a data storage device including a plurality of pre-populated parlay cards, such as pre-populated parlay card storage device 26, may be accessed in order to select one or more pre-populated parlay cards (step 620) for presentation to the player (step 625). The selection of pre-populated parlay cards may be done in any number of ways. For example, pre-populated parlay cards may be selected randomly, pseudo-randomly, and/or intentionally. When a pre-populated parlay card is selected intentionally, the selection may be responsive to, for example, the parameters received in step 610, one or more player characteristics as may be associated with the player via the player's login information and/or user account information, a preference of an administrator of the parlay card sweepstakes opportunity, and/or a direct request from the player. The selected pre-populated parlay card may be presented to the player via a web site, such as web site 400.

In step 630, actual outcomes for one or more of the events may be received. Exemplary actual outcomes include a winner of an event, a final score of an event, and a point spread between competitors for an event. Then, a player may be presented with a prize based on the combined actual outcomes of all of the individual events included in the pre-populated parlay card (step 635). In traditional parlay card betting schemes, a player wins a parlay card bet when he or she wins all of the wagers for each individual event in a winner-take-all fashion. With the parlay card sweepstakes opportunity of the present invention, a final, or grand prize, may be won by a single player or shared amongst multiple winners who share the same pre-populated parlay card. With the present invention, in some instances a player may be presented with a prize even when the actual outcome of all of the events as listed on the parlay card are not successful. For example, if a particular pre-populated parlay card includes two winning and three loosing actual event outcomes, the player may be awarded a prize that is less valuable than if the pre-populated card included five, or even four, winning actual event outcomes.

In some embodiments, a player may place a wager or bet prior to completion of one or more events included on a pre-populated parlay card and the prize awarded in step 635 may be, in part, dependent on the value or type of wager or bet placed. Currency for wagers or bets includes cash, accumulated points as may be earned through, for example, a customer loyalty program, or tasks completed to participate in the sweepstakes opportunity (e.g., viewing advertisements). In other embodiments, a player may share his or her participation in the parlay card sweepstakes opportunity with friends, family or other contacts via social media or other means. In some cases, a player may also invite friends, family or other contacts to participate in the parlay card sweepstakes opportunity via these means.

Exemplary prizes presented to player in step 635 include cash, merchandise, services, trips, additional sweepstakes opportunities, and so on. In the case of cash prizes, winnings may be distributed to the player by deposit to an existing player account, to a bank account designated by a player, to another financial institution account designated by the player (including an on-line account at a financial service provider such as PAYPAL), or by check. Other prizes may be shipped to the player at a designated address or, in the case of prizes amenable to distribution by way of email, through email. Alternatively, or in addition, players may be invited to collect their prizes in person at a designated location, such as the office of the service provider.

Figure 7:
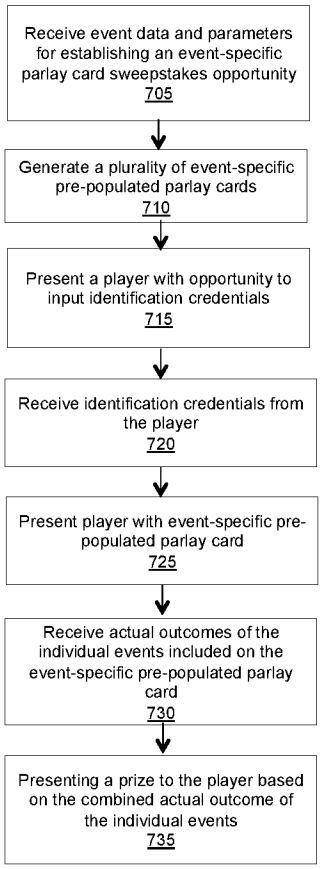

FIG. 7 provides a process 700 for presenting a parlay card sweepstakes opportunity to a player by, for example, a host computer via a web site. Process 700 may be executed by one or more components described herein.

Initially, in step 705, event data and one or more parameters for establishing an event-specific parlay card sweepstakes opportunity may be received from, for example, ad event coordinator. Exemplary event data that may be received in step 705 may relate to individualized and/or small-group types of events or event categories as may be set up by, for example, an individual or small group of individuals. For example, event-specific data regarding contestants competing in a reality TV contest may be received from a particular individual event coordinator so as to establish an event-specific parlay card sweepstakes opportunity to be shared with a limited number of friends and/or contacts. The event-specific data may include data entered specifically by the event coordinator and/or data regarding a particular event selected by the event coordinator that is received from various third-party sources, such as third-party website 28. Exemplary parameters received in step 705 include an identity requirement, which may serve to restrict participation in the event-specific parlay card sweepstakes opportunity to players selected and/or identified by the event coordinator.

In step 710, a plurality of event-specific pre-populated parlay cards may be generated using the event data and parameters received in step 705. Each of the event-specific pre-populated parlay cards may include a predicted outcome for each of a plurality of events included on the respective pre-populated parlay card.

When a player attempts to participate in an event-specific parlay card sweepstakes opportunity, he or she may be presented with an opportunity to input identification credentials via, for example, a web page as described herein (step 715). Upon receiving the identification credentials from the player (step 720) and verifying these credentials, the player may be presented with an event-specific pre-populated parlay card (step 725).

Actual outcomes regarding individual events included on the event-specific pre-populated parlay card may then be received (step 730) and a prize may be presented to the player raced on the combined actual outcome of the individual intends included on the event-specific pre-populated parlay card (step 735). Execution of steps 730 and 735 process 700 resemble execution of steps 630 and 635 as described above with regard to processes 600.

Figure 8:
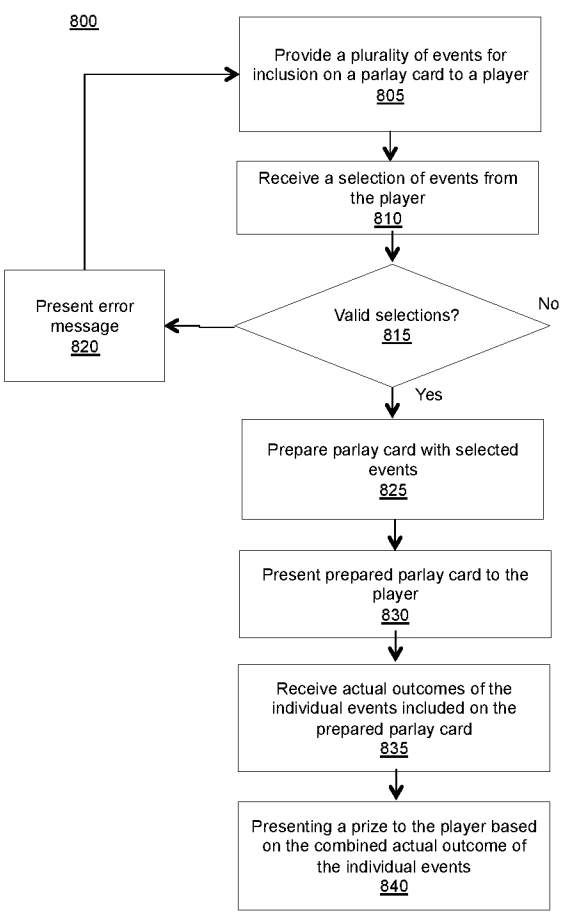

FIG. 8 provides a process 800 for presenting a parlay card sweepstakes opportunity to a player by, for example, a host computer via a web site. Process 800 may be executed by, for example, one or more components described herein.

In step 805, a plurality of events for inclusion on a parlay card may be provided to a player. The plurality of events may be presented to the player responsively to receiving an indication from the player that the player desires to participate in the parlay card sweepstakes opportunity upon, for example, receiving the player's login information and/or user account information. In some instances, the events presented to the player may correspond to a particular category or type of event that may be partially or wholly selected by the player and/or an administrator of the parlay card sweepstakes opportunity. The plurality of events may be presented to the user and a variety of ways. For example, the plurality of events may be presented to the user as a global list of all events available for selection or as a categorized list targeted to a particular criteria which, in some instances, may be configured by the user via selection of category or type of event from which to make a selection. Additionally, or alternatively, the targeting criteria for presenting the list may be configured by an administrator of the sweepstakes opportunity. For example, the list of events provided to the player may be dependent upon, for example, characteristics of the player (e.g., events or odds that are more favorable for preferred or incentivized players), a sponsor of the sweepstakes opportunity, the time of year, and/or an incentive desired by the administrator. In some embodiments, the plurality of events may be provided via a series of web pages by which a player may navigate through different events or categories of events so as make a selection.

In step 810, a selection of events for inclusion on a parlay card may be received from the player. Once the selections are received, they may be validated (step 815). Validating selections may be based on any number of factors including, but not limited to, the odds of a particular outcome for one or more of the selected events, the source of event information, the source of odds information, the odds of a parlay card win, a time proximity of the selection of the event to a commencement and/or conclusion of the event, a type or characteristic of a selected event and/or all of the selected events, and/or a prize on offer for winning the sweepstakes opportunity. In some cases, one or more factors included in the validity analysis may be included in a mathematical calculation, such as a dot product or statistical calculation.

In some instances, the validation step 815 may include an evaluation of a source of event data in order to determine, for example, a confidence level for the information and/or an organization supplying the information. In some circumstances, event data may be gathered from various sources in order to, for example, make an independent analysis of a probable event outcome. In some embodiments, the validation may include application of various weighting or statistical analysis to event data and the odds of a particular outcome.

In some embodiments, validation of the selected events may include determining whether the selected events, considered individually and/or as a whole, comply with one or more criteria or rules of the sweepstakes opportunity. For example, a rule for participating in a sweepstakes opportunity may require the odds of winning a wager or pick for an individual selected event or the aggregated selected events falls below a certain threshold, that the events occur at a particular time, and/or that a confidence level known for the odds of a particular outcome for an event, or series of events are accurate.

If one or more of the event selections and/or the grouping of selected events are not valid, an error message may be presented to the player (step 820). The error message may be a simple indication that an error has occurred and, in some instances may provide an opportunity for the player to cure the source of the invalidity by, for example, providing an error message indicating a required correction either on the event selection page or in a separate window. Optionally, presentation of the error message in step 820. On some occasions, the error message may provide a reason for the invalidity, and/or provide an opportunity to cure the invalidity by, for example, providing the player with one or more events to select as an alternative to an invalid event selection and/or group of invalid event selections may be followed by and/or accompanied with an opportunity to cure the source of the invalidity. For example, in some instances, the error message may trigger redirection of the user to a new page via which he or she may update or change an event selection and/or group of selections for inclusion on the parlay card.

When all of the event selections for the parlay card are valid, the parlay card may be prepared using the selected events (step 825). The prepared parlay card may then be presented to the player (step 830) in a manner similar to, for example, the presentation of the player with a pre-populated parlay card as discussed above with regard to steps 625 and 725 of processes 600 and 700, respectively.

In step 835, actual outcomes for one or more of the events may be received. Exemplary actual outcomes include a winner of an event, a final score of an event, and a point spread between competitors for an event. Then, a player may be presented with a prize based on the combined actual outcomes of all of the individual events included in the prepared parlay card (step 840). Execution of steps 835 and 840 of process 800 may resemble execution of steps 630 and 635 as well as steps 730 and 735 as described above with regard to processes 600 and 700, respectively.

Figure 9:
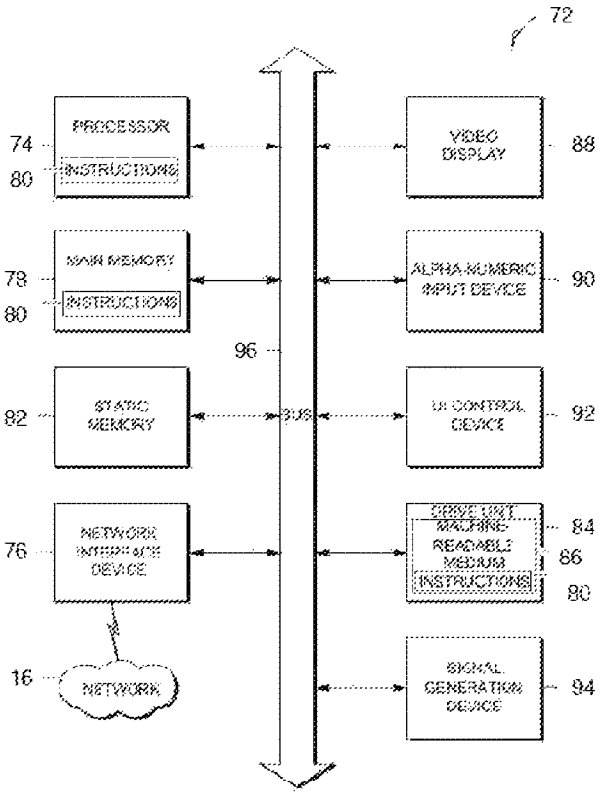
FIG. 9 illustrates an example of a computer system in which embodiments of the invention may be instantiated.

As evident from the foregoing discussion, one or more of the methods or processes described herein may be executable on various computer-based devices (e.g., clients 14*a*-14*n* and/or server 12). Such devices, an example (72) of which is illustrated in FIG. 9, may include any electronic device capable of performing the actions described above (using suitable programming) and, where applicable, processing the information for display so as to properly convey the information. Examples of such devices include desktop computers, laptop computers, cellphones, smart phones, tablet computers, computer game consoles, portable computer gaming consoles, media players, portable media players, other mobile devices, and the like.

In such devices, a processor 74 may control the overall functions of the electronic device such as running applications and controlling peripherals. Such a processor may be any type of processor and may communicate (e.g., via bus 96) with network interface device 76 to transmit and receive signals (e.g., cellular, Bluetooth, Wi-Fi, WiLAN, or other communication signals) over a network 16. The processor may use main memory 78 and/or a cache to store operating instructions 80 and to help in the execution of the operating instructions (e.g., such as the temporary storage of calculations and the like). The processor may also use non-transitory storage 82 and/or long-term storage 84 (such as a flash drive, hard disk or other unit comprising a tangible machine readable medium 86) to store and read instructions, files, and other data that requires long term, non-volatile storage.

The processor may communicate and control other peripherals, such as a display 88 with associated touch screen sensor, causing images to be displayed on the display and receiving input from the touch screen sensor when a user presses on the touch-screen display. In some examples, a touch screen sensor may be a multi-touch sensor capable of distinguishing and processing gestures.

The processor may receive input from a physical keyboard 90 and/or mouse/touch pad 92. In other examples, the device may utilize a touch screen keyboard using the display and touch screen sensor. The processor may produce audio output and other alerts that are played on a speaker or other signal generation device 94. A microphone (not shown) may be used as an input device for the processor to receive commands using voice-processing software. In the case of a client 14, an accelerometer may provide input on the motion of the device to the processor. An accelerometer may be used in motion sensitive applications, or, for example, in connection with scrolling content using tilting gestures, etc.

A Bluetooth module may be used to communicate with Bluetooth-enabled external devices. A USB port may enable external connections to other devices (e.g., mice or other cursor control devices) supporting the USB standard and charging capabilities. An external storage module may include any form of removable physical storage media such as a flash drive, micro SD card, SD card, Memory Stick, and the like.

Certain embodiments are described herein as including logic or a number of components, modules, or mechanisms. Modules or components may constitute software modules (e.g., code embodied on a non-transitory machine-readable medium) or hardware-implemented modules. A hardware-implemented module is a tangible unit capable of performing certain operations and may be configured or arranged in a certain manner. In example embodiments, one or more computer systems (e.g., a standalone, client or server computer system) or one or more processors may be configured by software (e.g., an application or application portion) as a hardware-implemented module that operates to perform certain operations as described herein.

In various embodiments, a hardware-implemented module may be implemented mechanically or electronically. For example, a hardware-implemented module may comprise dedicated circuitry or logic that is permanently configured (e.g., as a special-purpose processor, such as a field programmable gate array (FPGA) or an application-specific integrated circuit (ASIC)) to perform certain operations. A hardware-implemented module may also comprise programmable logic or circuitry (e.g., as encompassed within a general-purpose processor or other programmable processor) that is temporarily configured by software to perform certain operations. It will be appreciated that the decision to implement a hardware-implemented module mechanically, in dedicated and permanently configured circuitry, or in temporarily configured circuitry (e.g., configured by software) may be driven by cost and time considerations.

Accordingly, the term "hardware-implemented module" should be understood to encompass a tangible entity, be that an entity that is physically constructed, permanently configured (e.g., hardwired) or temporarily or transitorily configured (e.g., programmed) to operate in a certain manner and/or to perform certain operations described herein. Considering embodiments in which hardware-implemented modules are temporarily configured (e.g., programmed), each of the hardware-implemented modules need not be configured or instantiated at any one instance in time. For example, where the hardware-implemented modules comprise a general-purpose processor configured using software, the general-purpose processor may be configured as respective different hardware-implemented modules at different times. Software may accordingly configure a processor, for example, to constitute a particular hardware-implemented module at one instance of time and to constitute a different hardware-implemented module at a different instance of time.

Hardware-implemented modules may provide information to, and receive information from, other hardware-implemented modules. Accordingly, the described hardware-implemented modules may be regarded as being communicatively coupled. Where multiple of such hardware-implemented modules exist contemporaneously, communications may be achieved through signal transmission (e.g., over appropriate circuits and buses) that connects the hardware-implemented modules. In embodiments in which multiple hardware-implemented modules are configured or instantiated at different times, communications between such hardware-implemented modules may be achieved, for example, through the storage and retrieval of information in memory structures to which the multiple hardware-implemented modules have access. For example, one hardware-implemented module may perform an operation, and store the output of that operation in a memory device to which it is communicatively coupled. A further hardware-implemented module may then, at a later time, access the memory device to retrieve and process the stored output. Hardware-implemented modules may also initiate communications with input or output devices, and may operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

Similarly, the methods described herein may be at least partially processor-implemented. For example, at least some of the operations of a method may be performed by one or more processors or processor-implemented modules. The performance of certain of the operations may be distributed among the one or more processors, not only residing within a single machine, but also deployed across a number of machines. In some example embodiments, the processor or processors may be located in a single location, while in other embodiments the processors may be distributed across a number of locations.

The one or more processors may also operate to support performance of the relevant operations in a "cloud computing" environment or as a "software-as-a-service" (SaaS) service. For example, at least some of the operations may be performed by a group of computers (as examples of machines including processors), with these operations being accessible via a network (e.g., the Internet) and via one or more appropriate interfaces (e.g., Application Program Interfaces (APIs).)

Example embodiments may be implemented in digital electronic circuitry, or in computer hardware, firmware, software, or in combinations of them. Example embodiments may be implemented using a computer program product, e.g., a computer program tangibly embodied in an information carrier, e.g., in a machine-readable medium for execution by, or to control the operation of, data processing apparatus, e.g., a programmable processor, a computer, or multiple computers.

A computer program may be written in any form of programming language, including compiled or interpreted languages, and it may be deployed in any form, including as a stand-alone program or as a module, subroutine, or other unit suitable for use in a computing environment. A computer program may be deployed to be executed on one computer or on multiple computers at one site or distributed across multiple sites and interconnected by a communication network.

In example embodiments, operations may be performed by one or more programmable processors executing a computer program to perform functions by operating on input data and generating output. Method operations may also be performed by, and apparatus of example embodiments may be implemented as, special purpose logic circuitry, e.g., a field programmable gate array (FPGA) or an application-specific integrated circuit (ASIC).

The foregoing description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," and the like are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. For example, the code can be stored on one or more non-transitory, or non-volatile tangible computer-readable media, and may be loaded into volatile media during execution or at other times (e.g., during a transfer between storage devices, etc.). Examples of these tangible computer-readable media can include, but are not limited to, hard disks, removable magnetic disks, removable optical disks (e.g., compact disks and digital video disks), magnetic cassettes, memory cards or sticks, read only memories (ROMs), flash memories or other solid state devices (SSDs) and the like.

Hence, methods and systems for presenting parlay card opportunities to players have been herein described.

What is claimed is:

1. A method, comprising:

receiving at a server, from a user at a client communicably coupled to the server via a network, user input specifying selections from a database of events, said user input received via a web site interface provided to the client from the server, and said database of events accessible to said server;

organizing, by the server, the selections as contests between opposing parties for a proposed digital parlay card, and, upon receipt of a user indication that the selections from the database of events are complete, determining, by the server, whether the number of contests meets a pre-determined minimum number of contests for entry into a sweepstakes opportunity;

if the number of contests does not meet the pre-determined minimum number of contests for entry into the sweepstakes, prompting, by the server, via the web site interface, the user to make further selections from the database;

once the number of contests does meet the pre-determined minimum number of contests for entry into the sweepstakes, validating, by the server, the selections prior to generating the digital parlay card and providing a user an opportunity to cure an invalidity, then, upon validation of the digital parlay card, generating, by the server, the digital parlay card so as to include the contests according to the user's selections and presenting, by the server and via the web site interface, the digital parlay card to the user for selection of contest winners;

receiving, by the server, user designations for predicted winners of the contests included in the digital parlay card according to the user's selections, and storing, by the server, the designations as a completed digital parlay card;

receiving, by the server, actual outcome information for contests included on the completed digital parlay card; and if the digital parlay card is a winning parlay card, as determined by correlations between the predicted winners of the contests and the actual outcome information, presenting the user with a prize.

2. The method of claim 1, wherein validating the selections is based on one or more of the following factors: a likelihood of a particular outcome for a contest associated with the selections, a source of event information for events included in the selections, a source of odds information for a likelihood of a particular outcome for a contest, a likelihood of a parlay card win, a time proximity of the selections to a commencement and/or conclusion of an event, a type or characteristic of a selection, and a prize on offer for winning the sweepstakes opportunity.

3. The method of claim 1, wherein eligibility for prizes associated with the sweepstakes opportunity is determined based on the number of contests selected for inclusion on the digital parlay card.

4. The method of claim 1, wherein events presented to the user for selection correspond to particular categories or types of events partially or wholly selected by the user.

5. The method of claim 1, wherein events presented to the user for selection correspond to particular categories or types of events partially or wholly selected by an administrator of the sweepstakes opportunity.

6. The method of claim 1, wherein events presented to the user for selection are presented as one of: a list of all events available for selection, or a categorized list targeted to particular criteria.

7. The method of claim 6, wherein the particular criteria are configured by the user via selection of category or type of event criteria from which to make a selection.

8. The method of claim 6, wherein the categorized list targeted to particular criteria is configured by an administrator of the sweepstakes opportunity.

9. The method of claim 6, wherein the categorized list targeted to particular criteria is dependent upon one or more of: characteristics of the user, a sponsor of the sweepstakes opportunity, time of year, and an incentive desired by an administrator of the sweepstakes opportunity.

10. A computer-implemented method of providing a parlay card sweepstakes opportunity to a player, comprising:

generating, by a server, and presenting the player, via a web site interface displayed at a client device communicably coupled to the server via a network, a pre-populated parlay card associated with a parlay card sweepstakes opportunity, the pre-populated parlay card including a plurality of events, each respective event of the plurality of events selected by the server from one or more data stores of information concerning upcoming events and each respective event having associated player-selectable options for the selection of a predicted outcome;

receiving, by the server and from the player at the client device, a completed parlay card, the completed parlay card comprising predicted outcomes for each respective event included in the pre-populated parlay card, said predicted outcomes indicated by selections of respective ones of the player-selectable options;

receiving, by the server, actual outcome information regarding the plurality of events included on the pre-populated parlay card; and presenting a prize to the player based on a combined actual outcome of the plurality of events included on the pre-populated parlay card.

11. The computer-implemented method of claim 10, wherein the events for the pre-populated parlay card are selected from the one or more data stores of information concerning upcoming events according to odds of likely outcomes of the upcoming contests.

12. The computer-implemented method of claim 10, wherein prior to generation and presentation of the pre-populated parlay card, receiving from the player via the web site interface one or more of: a selection of a number of events to be included on the pre-populated parlay card, a selection of a category of event to be included on the pre-populated parlay card, a selection of a date range for occurrence of the events to be included on the pre-populated parlay card, and a selection of the prize to be awarded to the player.

13. The computer-implemented method of claim 12, wherein prior to generation and presentation of the pre-populated parlay card the player is presented with an advertisement via the web site interface.

14. The computer-implemented method of claim 10, further comprising varying the events included on the pre-populated parlay card according to a schedule.

15. The computer-implemented method of claim 10, further comprising:

receiving event data prior to presenting the player with the parlay card sweepstakes opportunity;

analyzing the event data so as to categorize the event data; and generating a plurality of pre-populated parlay cards using the categorized event data.

16. A computer-implemented method of providing a parlay card sweepstakes opportunity to a player, comprising:

receiving, by a server and from the player, a request for a pre-populated parlay card;

generating, by the server, and presenting, via a web site interface displayed at a client communicably coupled to the server, to the player the pre-populated parlay card, said pre-populated parlay card specifying a plurality of events, each respective event of the plurality of events associated with a predicted outcome of the respective event, wherein the events for the pre-populated parlay card are selected by the server from one or more data stores of information concerning upcoming events according to odds of likely outcomes of the upcoming contests;

receiving, by the server, actual outcome information regarding the plurality of events specified on the pre-populated parlay card; and presenting a prize to the player based on a combined actual outcome of the plurality of events included on the pre-populated parlay card.

17. The computer-implemented method of claim 16, wherein prior to generation and presentation of the pre-populated parlay card, receiving from the player via the web site interface one or more of: a selection of a number of events to be included on the pre-populated parlay card, a selection of a category of event to be included on the pre-populated parlay card, a selection of a date range for occurrence of the events to be included on the pre-populated parlay card, and a selection of the prize to be awarded to the player.

18. The computer-implemented method of claim 16, wherein prior to generation and presentation of the pre-populated parlay card, receiving from the player via the web site interface a selection of a number of events to be included on the pre-populated parlay card and a selection of a category of event to be included on the pre-populated parlay card.

* * * * *